US007811113B2

(12) United States Patent
Hughes

(10) Patent No.: US 7,811,113 B2
(45) Date of Patent: Oct. 12, 2010

(54) ELECTRICAL CONNECTOR WITH FAULT CLOSURE LOCKOUT

(75) Inventor: David Charles Hughes, Rubicon, WI (US)

(73) Assignee: Cooper Technologies Company, Houston, TX (US)

( * ) Notice: Subject to any disclaimer, the term of this patent is extended or adjusted under 35 U.S.C. 154(b) by 115 days.

(21) Appl. No.: 12/047,094

(22) Filed: Mar. 12, 2008

(65) Prior Publication Data

US 2009/0233472 A1 Sep. 17, 2009

(51) Int. Cl.
*H01R 13/52* (2006.01)

(52) U.S. Cl. ..... 439/278; 439/921; 439/923

(58) Field of Classification Search ..... 439/278, 439/921, 205.6, 923, 693, 205
See application file for complete search history.

(56) References Cited

U.S. PATENT DOCUMENTS

| | | | |
|---|---|---|---|
| 1,903,956 | A | 4/1933 | Christie et al. |
| 2,953,724 | A | 9/1960 | Hilfiker et al. |
| 3,115,329 | A | 12/1963 | Wing et al. |
| 3,315,132 | A | 4/1967 | Raymond |
| 3,392,363 | A | 7/1968 | Geis, Jr., et at. |
| 3,471,669 | A | 10/1969 | Curtis |
| 3,474,386 | A | 10/1969 | Link |
| 3,509,516 | A | 4/1970 | Phillips |
| 3,509,518 | A | 4/1970 | Phillips |
| 3,513,425 | A | 5/1970 | Arndt |
| 3,539,972 | A | 11/1970 | Silva et at. |
| 3,542,986 | A | 11/1970 | Kotski |
| 3,546,535 | A | 12/1970 | Van Riemsdijk |
| 3,576,493 | A | 4/1971 | Tachick et al. |
| 3,594,685 | A | 7/1971 | Cunningham |
| 3,652,975 | A | 3/1972 | Keto |
| 3,654,590 | A | 4/1972 | Brown |
| 3,663,928 | A | 5/1972 | Keto |
| 3,670,287 | A | 6/1972 | Keto |
| 3,678,432 | A | 7/1972 | Boliver |
| 3,720,904 | A | 3/1973 | De Sio |

(Continued)

FOREIGN PATENT DOCUMENTS

| | | |
|---|---|---|
| DE | 3110609 | 10/1982 |

(Continued)

OTHER PUBLICATIONS

U.S. Appl. No. 11/809,508, Hughes et al.

(Continued)

*Primary Examiner*—Tho D Ta
*Assistant Examiner*—Travis Chambers
(74) *Attorney, Agent, or Firm*—King & Spalding LLP

(57) ABSTRACT

An electrical connector, such as a bushing insert, with a fault-closure lockout feature includes a housing with an inner bore having opposite ends. One end has an opening providing access to the inner bore. A piston-contact element is movable between first and second axially spaced positions within the inner bore. During fault conditions, the piston-contact element moves from the first position to the second position to accelerate connection with a male contact of another electrical connector, such as a cable connector, thereby inhibiting the formation of flashover or electrical arc. After fault closure, a lockout member on the piston-contact element prevents moving the piston-contact element from the second position to the first position.

33 Claims, 8 Drawing Sheets

U.S. PATENT DOCUMENTS

| | | | | |
|---|---|---|---|---|
| 3,725,846 | A | | 4/1973 | Strain |
| 3,740,503 | A | | 6/1973 | Tomohiro et al. |
| 3,740,511 | A | | 6/1973 | Westmoreland |
| 3,798,586 | A | | 3/1974 | Huska |
| 3,826,860 | A | | 7/1974 | De Sio at al. |
| 3,845,233 | A | | 10/1974 | Burton |
| 3,860,322 | A | | 1/1975 | Sankey et al. |
| 3,915,534 | A | | 10/1975 | Yonkers |
| 3,924,914 | A | | 12/1975 | Banner |
| 3,945,699 | A | | 3/1976 | Westrom |
| 3,949,343 | A | | 4/1976 | Yonkers |
| 3,953,099 | A | | 4/1976 | Wilson |
| 3,955,874 | A | | 5/1976 | Boliver |
| 3,957,332 | A | | 5/1976 | Lambert, III |
| 3,960,433 | A | | 6/1976 | Boliver |
| 4,029,380 | A | | 6/1977 | Yonkers |
| 4,040,696 | A | | 8/1977 | Wada et al. |
| 4,067,636 | A | | 1/1978 | Boliver et al. |
| 4,088,383 | A | | 5/1978 | Fischer et al. |
| 4,102,608 | A | | 7/1978 | Balkau et al. |
| 4,103,123 | A | | 7/1978 | Marquardt |
| 4,107,486 | A | | 8/1978 | Evnas |
| 4,113,339 | A | | 9/1978 | Eley |
| 4,123,131 | A | | 10/1978 | Pearce, Jr. et al. |
| 4,152,643 | A | | 5/1979 | Schweitzer |
| 4,154,993 | A | | 5/1979 | Kumbera et al. |
| 4,161,012 | A | | 7/1979 | Cunningham |
| 4,163,118 | A | | 7/1979 | Marien et al. |
| 4,186,985 | A | | 2/1980 | Stepniak et al. |
| 4,203,017 | A | | 5/1980 | Lee |
| 4,210,381 | A | | 7/1980 | Borgstrom |
| 4,223,179 | A | | 9/1980 | Lusk et al. |
| 4,260,214 | A | | 4/1981 | Dorn |
| 4,343,356 | A | | 8/1982 | Riggs et al. |
| 4,353,611 | A | | 10/1982 | Siebens et al. |
| 4,354,721 | A | | 10/1982 | Luzzi |
| 4,360,967 | A | | 11/1982 | Luzzi et al. |
| 4,443,054 | A | | 4/1984 | Ezawa et al. |
| 4,456,450 | A | * | 6/1984 | Heling ..... 425/376.1 |
| 4,463,227 | A | | 7/1984 | Dizon et al. |
| 4,484,169 | A | | 11/1984 | Nishikawa |
| 4,500,935 | A | | 2/1985 | Tsuruta et al. |
| 4,508,413 | A | | 4/1985 | Bailey |
| 4,516,823 | A | | 5/1985 | Filter et al. |
| 4,568,804 | A | | 2/1986 | Leuhring |
| 4,600,260 | A | | 7/1986 | Stepniak et al. |
| 4,626,755 | A | | 12/1986 | Butcher et al. |
| 4,638,403 | A | | 1/1987 | Amano et al. |
| 4,678,253 | A | | 7/1987 | Hicks et al. |
| 4,688,013 | A | | 8/1987 | Nishikawa |
| 4,700,258 | A | | 10/1987 | Farmer |
| 4,715,104 | A | | 12/1987 | Schoenwetter et al. |
| 4,722,694 | A | | 2/1988 | Makal et al. |
| 4,767,894 | A | | 8/1988 | Schombourg |
| 4,767,941 | A | | 8/1988 | Brand et al. |
| 4,779,341 | A | | 10/1988 | Roscizewski |
| 4,793,637 | A | | 12/1988 | Laipply et al. |
| 4,799,895 | A | | 1/1989 | Borgstrom |
| 4,820,183 | A | | 4/1989 | Knapp et al. |
| 4,822,291 | A | | 4/1989 | Cunningham |
| 4,822,951 | A | | 4/1989 | Wilson et al. |
| 4,834,677 | A | | 5/1989 | Archang |
| 4,857,021 | A | | 8/1989 | Boliver et al. |
| 4,863,392 | A | | 9/1989 | Borgstrom et al. |
| 4,867,687 | A | | 9/1989 | Williams et al. |
| 4,871,888 | A | | 10/1989 | Bestel |
| 4,891,016 | A | | 1/1990 | Luzzi et al. |
| 4,911,655 | A | | 3/1990 | Pinyan et al. |
| 4,913,658 | A | | 4/1990 | Borgstrom et al. |
| 4,946,393 | A | | 8/1990 | Borgstrom |
| 4,955,823 | A | | 9/1990 | Luzzi |
| 4,972,049 | A | | 11/1990 | Muench |
| 4,982,059 | A | | 1/1991 | Bestel |
| 5,025,121 | A | | 6/1991 | Allen et al. |
| 5,045,656 | A | | 9/1991 | Kojima |
| 5,045,968 | A | | 9/1991 | Suzuyama et al. |
| 5,053,584 | A | | 10/1991 | Chojnowski |
| 5,101,080 | A | | 3/1992 | Ferenc |
| 5,114,357 | A | | 5/1992 | Luzzi |
| 5,128,824 | A | | 7/1992 | Yaworski et al. |
| 5,130,495 | A | | 7/1992 | Thompson |
| 5,166,861 | A | | 11/1992 | Krom |
| 5,175,403 | A | | 12/1992 | Hamm et al. |
| 5,213,517 | A | | 5/1993 | Kerek et al. |
| 5,221,220 | A | | 6/1993 | Roscizewski |
| 5,230,142 | A | | 7/1993 | Roscizewski |
| 5,230,640 | A | | 7/1993 | Tardif |
| 5,248,263 | A | | 9/1993 | Sakurai et al. |
| 5,266,041 | A | | 11/1993 | De Luca |
| 5,277,605 | A | | 1/1994 | Roscizewski et al. |
| 5,356,304 | A | | 10/1994 | Colleran |
| 5,358,420 | A | | 10/1994 | Cairns et al. |
| 5,359,163 | A | | 10/1994 | Woodard |
| 5,393,240 | A | | 2/1995 | Makal et al. |
| 5,422,440 | A | | 6/1995 | Palma |
| 5,427,538 | A | | 6/1995 | Knapp et al. |
| 5,429,519 | A | | 7/1995 | Murakami et al. |
| 5,433,622 | A | | 7/1995 | Galambos |
| 5,435,747 | A | | 7/1995 | Franckx et al. |
| 5,445,533 | A | | 8/1995 | Roscizewski et al. |
| 5,468,164 | A | | 11/1995 | Demissy |
| 5,492,487 | A | | 2/1996 | Cairns et al. |
| 5,525,069 | A | | 6/1996 | Roscizewski et al. |
| 5,589,671 | A | | 12/1996 | Hackbarth et al. |
| 5,619,021 | A | | 4/1997 | Yamamoto et al. |
| 5,641,310 | A | | 6/1997 | Tiberio, Jr. |
| 5,655,921 | A | | 8/1997 | Makal |
| 5,661,280 | A | | 8/1997 | Kuss et al. |
| 5,667,060 | A | | 9/1997 | Luzzi |
| 5,717,185 | A | | 2/1998 | Smith |
| 5,736,705 | A | | 4/1998 | Bestel et al. |
| 5,737,874 | A | | 4/1998 | Sipos et al. |
| 5,747,765 | A | | 5/1998 | Bestel et al. |
| 5,747,766 | A | | 5/1998 | Waino et al. |
| 5,757,260 | A | | 5/1998 | Smith et al. |
| 5,766,030 | A | | 6/1998 | Suzuki |
| 5,766,517 | A | | 6/1998 | Goedde et al. |
| 5,795,180 | A | | 8/1998 | Siebens |
| 5,808,258 | A | | 9/1998 | Luzzi |
| 5,816,835 | A | | 10/1998 | Meszaros |
| 5,846,093 | A | | 12/1998 | Muench et al. |
| 5,857,862 | A | | 1/1999 | Muench et al. |
| 5,864,942 | A | | 2/1999 | Luzzi |
| 5,912,604 | A | | 6/1999 | Harvey et al. |
| 5,917,167 | A | | 6/1999 | Bestel |
| 5,936,825 | A | | 8/1999 | DuPont |
| 5,949,641 | A | | 9/1999 | Walker et al. |
| 5,953,193 | A | | 9/1999 | Ryan |
| 5,957,712 | A | | 9/1999 | Stepniak |
| 6,022,247 | A | | 2/2000 | Akiyama et al. |
| 6,040,538 | A | | 3/2000 | French et al. |
| 6,042,407 | A | | 3/2000 | Scull et al. |
| 6,069,321 | A | | 5/2000 | Wagener et al. |
| 6,130,394 | A | | 10/2000 | Hogl |
| 6,168,447 | B1 | | 1/2001 | Stepniak et al. |
| 6,205,029 | B1 | | 3/2001 | Byrne et al. |
| 6,213,799 | B1 | | 4/2001 | Jazowski et al. |
| 6,220,888 | B1 | | 4/2001 | Correa |
| 6,227,908 | B1 | | 5/2001 | Aumeier |
| 6,250,950 | B1 | | 6/2001 | Pallai |
| 6,280,659 | B1 | | 8/2001 | Sundin |
| 6,332,785 | B1 | | 12/2001 | Muench, Jr. et al. |
| 6,338,637 | B1 | | 1/2002 | Muench, Jr. et al. |
| 6,362,445 | B1 | | 3/2002 | Mearchland et al. |

| | | | | |
|---|---|---|---|---|
| 6,364,216 | B1 | 4/2002 | Martin | |
| 6,416,338 | B1 | 7/2002 | Berlovan | |
| 6,453,776 | B1 | 9/2002 | Beattie et al. | |
| 6,504,103 | B1 | 1/2003 | Meyer et al. | |
| 6,517,366 | B2 | 2/2003 | Bertini et al. | |
| 6,520,795 | B1 | 2/2003 | Jazowski | |
| 6,538,312 | B1 | 3/2003 | Peterson et al. | |
| 6,542,056 | B2 | 4/2003 | Nerstron et al. | |
| 6,566,996 | B1 | 5/2003 | Douglass et al. | |
| 6,585,531 | B1 | 7/2003 | Stepniak et al. | |
| 6,664,478 | B2 | 12/2003 | Mohan et al. | |
| 6,674,159 | B1 | 1/2004 | Peterson et al. | |
| 6,689,947 | B2 | 2/2004 | Ludwig | |
| 6,705,898 | B2 | 3/2004 | Pechstein et al. | |
| 6,709,294 | B1 | 3/2004 | Cohen et al. | |
| 6,733,322 | B2 | 5/2004 | Boemmel et al. | |
| 6,744,255 | B1 | 6/2004 | Steinbrecher et al. | |
| 6,790,063 | B2 | 9/2004 | Jazowski et al. | |
| 6,796,820 | B2 | 9/2004 | Jazowski et al. | |
| 6,809,413 | B1 | 10/2004 | Peterson et al. | |
| 6,811,418 | B2 | 11/2004 | Jazowski et al. | |
| 6,830,475 | B2 | 12/2004 | Jazowski et al. | |
| 6,843,685 | B1 | 1/2005 | Borgstrom et al. | |
| 6,888,086 | B2 | 5/2005 | Daharsh et al. | |
| 6,905,356 | B2 | 6/2005 | Jazowski et al. | |
| 6,936,947 | B1 | 8/2005 | Leijon et al. | |
| 6,939,151 | B2 | 9/2005 | Borgstrom et al. | |
| 6,972,378 | B2 | 12/2005 | Schomer et al. | |
| 6,976,327 | B2 * | 12/2005 | Goodin et al. | 40/633 |
| 6,984,791 | B1 * | 1/2006 | Meyer et al. | 174/167 |
| 7,018,236 | B2 | 3/2006 | Nishio et al. | |
| 7,019,606 | B2 | 3/2006 | Williams et al. | |
| 7,044,760 | B2 | 5/2006 | Borgstrom et al. | |
| 7,044,769 | B2 | 5/2006 | Zhao et al. | |
| 7,050,278 | B2 | 5/2006 | Poulsen | |
| 7,059,879 | B2 * | 6/2006 | Krause et al. | 439/181 |
| 7,077,672 | B2 | 7/2006 | Krause et al. | |
| 7,079,367 | B1 | 7/2006 | Liljestrand | |
| 7,083,450 | B1 | 8/2006 | Hughes | |
| 7,104,822 | B2 | 9/2006 | Jazowski et al. | |
| 7,104,823 | B2 | 9/2006 | Jazowski et al. | |
| 7,108,568 | B2 | 9/2006 | Jazowski et al. | |
| 7,134,889 | B2 * | 11/2006 | Hughes et al. | 439/184 |
| 7,150,098 | B2 | 12/2006 | Borgstrom et al. | |
| 7,168,983 | B2 | 1/2007 | Graf et al. | |
| 7,170,004 | B2 | 1/2007 | Gramespacher et al. | |
| 7,182,647 | B2 | 2/2007 | Muench et al. | |
| 7,212,389 | B2 | 5/2007 | Hughes | |
| 7,216,426 | B2 | 5/2007 | Borgstrom et al. | |
| 7,234,980 | B2 | 6/2007 | Jazowski et al. | |
| 7,247,061 | B2 | 7/2007 | Hoxha et al. | |
| 7,247,266 | B2 | 7/2007 | Bolcar | |
| 7,258,585 | B2 | 8/2007 | Hughes et al. | |
| 7,278,889 | B2 | 10/2007 | Muench et. al. | |
| 7,341,468 | B2 | 3/2008 | Hughes et al. | |
| 2001/0008810 | A1 | 7/2001 | George et al. | |
| 2002/0055290 | A1 | 5/2002 | Jazowski et al. | |
| 2003/0228779 | A1 | 12/2003 | Jazowski et al. | |
| 2004/0121657 | A1 | 6/2004 | Muench et al. | |
| 2005/0208808 | A1 | 9/2005 | Jazowski et al. | |
| 2005/0212629 | A1 | 9/2005 | William et al. | |
| 2005/0260876 | A1 | 11/2005 | Krause et al. | |
| 2006/0110983 | A1 | 5/2006 | Muench et al. | |
| 2006/0160388 | A1 | 7/2006 | Hughes et al. | |
| 2006/0216992 | A1 | 9/2006 | Hughes et al. | |
| 2007/0026713 | A1 | 2/2007 | Hughes et al. | |
| 2007/0026714 | A1 | 2/2007 | Hughes et al. | |
| 2007/0032110 | A1 | 2/2007 | Hughes et al. | |
| 2007/0097601 | A1 | 5/2007 | Hughes et al. | |
| 2007/0108164 | A1 | 5/2007 | Muench et al. | |

FOREIGN PATENT DOCUMENTS

| | | | |
|---|---|---|---|
| DE | 3521365 | | 2/1987 |
| DE | 19906972 | A1 | 2/1999 |
| EP | 0624940 | | 11/1994 |
| EP | 0782162 | A2 | 7/1997 |
| EP | 0957496 | | 11/1999 |
| FR | 2508729 | | 12/1982 |
| GB | 105227 | | 2/1918 |
| GB | 2254493 | | 10/1992 |
| JP | S62-198677 | | 12/1987 |
| JP | S63-93081 | | 6/1988 |
| JP | H1-175181 | | 7/1989 |
| JP | H3-88279 | | 9/1991 |
| JP | H4-54164 | | 5/1992 |
| WO | WO 00/41199 | | 7/2000 |

OTHER PUBLICATIONS

U.S. Appl. No. 11/738,995, Steinbrecher et al.
U.S. Appl. No. 11/738,948, Hughes et al.
U.S. Appl. No. 11/738,941, Hughes et al.
U.S. Appl. No. 11/688,673, Hughes et al.
U.S. Appl. No. 11/688,648, Hughes et al.
U.S. Appl. No. 11/677,703, Hughes et al.
U.S. Appl. No. 11/676,861, Hughes et al.
Loadbreak Apparatus Connectors Service Information 500-26, Cooper Power Systems, May 2003, Waukesha, WI.
Deadbreak Apparatus Connectors Electrical Apparatus, Cooper Power Systems, Jul. 1999, Marketing Material.
Link-Op 600A Operable Connector System, Marketing Material, Sep. 1989.
Installation Instructions, 650LK-B Link Operable Connector System (Bolted) May 1, 1989.
G&W Electric Co.; "Breakthrough in Switching Technology; Solid Dielectric Switchgear"; Oct. 2001; Blue Island, IL.
Cooper Power Systems; "Padmounted Switchgear; Type RVAC, Vacuum-Break Switch, Oil-Insulated or SF.sub.6-Insulated; Electrical Apparatus 285-50"; Jul. 1998 .
Cooper Power Systems; "Padmounted Switchgear; Type MOST Oil Switch; Electrical Apparatus 285-20"; Jul. 1998.
Cooper Power Systems; "Molded Rubber Products; 600 A 35 kV Class Bol-T.TM. Deadbreak Connector; Electrical Apparatus 600-50"; Jan. 1990.
Cooper Power Systems; "Padmounted Switchgear; Kyle.RTM. Type VFI Vacuum Fault Interrupter; Electrical Apparatus 285-10", Jan. 1998.
"Loadbreak Appatus Connectors, 200 A 25kV Class—Expanded Range Loadbreak Elbow Connector, Electrical Apparatus 500-28"; Cooper Power Systems; pp. 1-4; (Jan. 2004).
Kevin Fox, "The Cooper Posi-Break.TM. Solution to Separable Connector Switching Problems at Wisconsin Electric Power Company," Component Products, Bulletin No. 98065, copyright 1998 Cooper Power Systems, MI 10/98 5M, 2 total pages.
"The Cooper Posi-Break.TM., Elbow and Cap, Engineered Solution Increases Strike Distance and Improves Reliability," copyright 1998 Cooper Power Systems, Inc., Bulletin 98014, MI 398/15M, 6 total pages.
Loadbreak Apparatus Connectors, "200 A 25 kV Class Loadbreak Bushing Insert," Service Information 500-26, Cooper Power Systems, May 2003, pp. 1-2.
Loadbreak Apparatus Connectors, "200 A kV Class Cooper Posi-Break.TM. Expanded Range Loadbreak Elbow Connector," Service Information 500-29, Cooper Power Systems, Jan. 2004, pp. 1-4.
Product Brief, "Latched Elbow Indicator," Cooper Power Systems, Bulletin 94014, Apr. 1994, 1 total page.
"Stick-OPerable 600-Amp Connector Systems," *Elastimold, Amerace Corporation*, Feb. 1984, 11 pages.
"Molded Rubber Products, 600 A 15 kV Class T-OP™ II Deadbreak Connector Electrical Apparatus 600-12," *Cooper Power Systems*, Jul. 2005, pp. 1-4.

"Molded Rubber Products, 600 A 15 and 25 kV Deadbreak Accessories, Tools, Replacement Parts Electrical Apparatus 600-46"; *Cooper Power Systems*, Jul. 1997, pp. 1-4.

"Molded Rubber Products, 600 A 25 kV Class BT-TAP™ Deadbreak Connector Electrical Apparatus, 600-35," *Cooper Power Systems*, Mar. 2003, pp. 1-5.

"Deadbreak Apparatus Connectors, 600 A 15/25 kV Class Bol-T™ Deadbreak Connector Electrical Apparatus 600-10," *Cooper Power Systems*, Aug. 2002, 6 pages.

"Deadbreak Apparatus Connector, 600 A 25 kV Class Bushing Adapter for T-OP™ II Connector Systems (including LRTP and Bushing Extender) Electrical Apparatus 600-38," *Cooper Power Systems*, Jun. 1997, pp. 1-4.

"Loadbreak Apparatus Connectors, 200 A 15 kV Class Loadbreak Bushing Insert 500-12," *Cooper Power Systems*, Nov. 1995, pp. 1-2.

"T-OP™ II: How Many Sticks Does It Take to Operate Your 600 Amp Terminator System?," *Cooper Power Systems*, Jul. 1994, 4 pages.

"Installation & Operation Instructions 168ALR, Access Port Loadbreak Elbow Connectors"; *Elastimold IS-168ALR* (*Rev. C*); pp. 1-5; (Feb. 1, 1994).

"Operating Instructions 200TC-2"; *Elastimold IS-200TC* (*Rev-A*); pp. 1-2; (Feb. 26, 1995).

"Surge Arresters"; *Elastimold Catalog*; pp. 26-27; (2001).

"Surge Arresters, Metal Oxide Varistor elbow (M.O.V.E.™) Surge Arrester Electrical Apparatus 235-65"; *Cooper Power Systems*; pp. 1-4; Dec. 2003.

"Surge Arresters, Metal Oxide Elbow Surge Arrester Electrical Apparatus 235-65"; *Cooper Power Systems*; pp. 1-4; Jan. 1991.

"Surge Arresters, Metal Oxide Varistor (MOV) Parking Stand Surge Arrester Electrical Apparatus 235-68"; *Cooper Power Systems*; pp. 1-3; Apr. 2002.

"INJPLUG35, 35 kV Amp Loadbreak Injection Plug Operating and Installation Instructions"; *Cooper Power Systems*; p. 1; (Sep. 2002).

"Loadbreak Apparatus Connectors, 200 A 15 kV Class Loadbreak Elbow Connector, Electrical Apparatus 500-10"; *Cooper Power Systems*; pp. 1-4; (Feb. 2004).

"Loadbreak Apparatus Connectors, 200 A 15 kV and 25 kV Class Elbow Installation Instructions, Service Information S500-10-1"; *Cooper Power Systems*; pp. 1-4; (Feb. 2001).

"Loadbreak Apparatus Connectors, 200 A 15kV Class Loadbreak Bushing Insert 500-12"; *Cooper Power Systems*; pp. 1-2; (Nov. 1995).

"Loadbreak Apparatus Connectors, 200 A 15kV Class Loadbreak Rotatable Feedthru Insert; Electrical Apparatus 500-13"; *Cooper Power Systems*; pp. 1-2; (Apr. 2001).

"Loadbreak Apparatus Connectors, 200 A 25 kV Class—Expanded Range Loadbreak Elbow Connector, Electrical Apparatus 500-28"; *Cooper Power Systems*; pp. 1-4; (Jan. 2004).

"Loadbreak Apparatus Connectors, 200 A 25 kV Class Rotatable Feedthru Insert, Electrical Apparatus 500-30"; *Cooper Power Systems*; pp. 1-2; (Jun. 1999).

"Loadbreak Apparatus Connectors, 200 A 35 kV Class Three-Phase Loadbreak Injection Elbow Installation Instructions, Service Information S500-55-2"; *Cooper Power Systems*; pp. 1-6; (Apr. 1999).

Cooper Power Systems, *Deadbreak Apparatus Connectors*, "600 A 15/25 kV Clas Bol-T™ Deadbreak Connector", Electrical Apparatus 600-30, pp. 1-6, Feb. 2003.

Cooper Power Systems, *Deadbreak Apparatus Connectors*, "600 A 15/25 kV Class PUSH-OP® Deadbreak Connector", Electrical Apparatus 600-33, pp. 1-4, Nov. 2004.

Cooper Power systems, *Molded Rubber Products*, "600 A 15/25 kV Class T-OP™ II Deadbreak Connector", Electrical Apparatus 600-32, pp. 1-4, Jul. 2005.

Cooper Power Systems, *OEM Equipment*, "Four-Position Sectionalizing Loadbreak Switches", Electrical Apparatus 800-64, pp. 1-8, Dec. 2003.

* cited by examiner

ELECTRICAL CONNECTOR WITH FAULT CLOSURE LOCKOUT

FIELD OF THE INVENTION

The invention relates generally to an electrical connector for a power distribution system. More specifically, the invention relates to an electrical connector, such as a bushing insert, having a lockout feature that prevents resetting a movable piston-contact element after a fault closure event.

BACKGROUND

Conventional high voltage electrical connectors, such as bushing inserts, connect such devices as transformers to electrical equipment of a power distribution system. Typically, the electrical connector is connected to another electrical device of the power distribution system, such as a cable connector, with female contacts of the electrical connector mating with male contacts of the cable connector.

During connection of the electrical connector and cable connector under a load, an arc is struck between the contact elements as they approach one another. The arc formed during loadmake is acceptable since the arc is generally of moderate intensity and is quenched as soon as the contact elements are engaged. However, during fault closure or short circuit conditions, a substantial arc can occur between the contact elements of the connectors, resulting in catastrophic failure of the electrical connector including extensive damage and possible explosion.

Conventional electrical connectors employ a piston that moves the female contact of the electrical connector into engagement with the male contact of the cable connector during fault conditions, thereby accelerating the engagement of the contacts (hereinafter a "fault closure"), which in turn substantially eliminates any arc formed therebetween. After such a fault closure, the electrical connector is not suitable for further use and must be replaced. More specifically, the substantial arc generated during fault closure damages the female contact of the electrical connector such that the female contact will not perform during a subsequent fault closure. However, linemen in the field sometimes reset the piston in the electrical connector by forcing the piston back into its original position before the fault closure. At this point, the electrical connector appears as if it has not endured a fault closure. During a subsequent fault closure, the female contact of the electrical connector will not completely engage the male contact of the cable connector, and the fault closure will not be completed.

Accordingly, a need exists in the art for preventing the resetting of the piston of an electrical connector after a fault closure event.

SUMMARY OF THE INVENTION

The invention relates to preventing the resetting of a moveable member of an electrical connector after a fault closure. When an electrical connector and a cable connector are engaged together during a fault closure, a piston-contact element with a female contact moves forward within the electrical connector to engage a male contact in the cable connector. The piston-contact element moves forward until a piston contact stop on the piston-contact element engages a stop ring in the electrical connector, which prevents further forward movement of the piston contact element. Additionally, a piston lockout member on the piston-contact element prevents movement of the piston-contact element in the opposite direction, thereby preventing the resetting of the piston-contact element to its original position. More specifically, the piston lockout member of the piston-contact element engages the stop ring in the electrical connector to prevent movement of the piston-contact element to its original position.

These and other aspects, objects, and features of the invention will become apparent from the following detailed description of the exemplary embodiments, read in conjunction with, and reference to, the accompanying drawings.

DETAILED DESCRIPTION OF EXEMPLARY EMBODIMENTS

The following description of exemplary embodiments refers to the attached drawings, in which like numerals indicate like elements throughout the figures.

Figure 1:
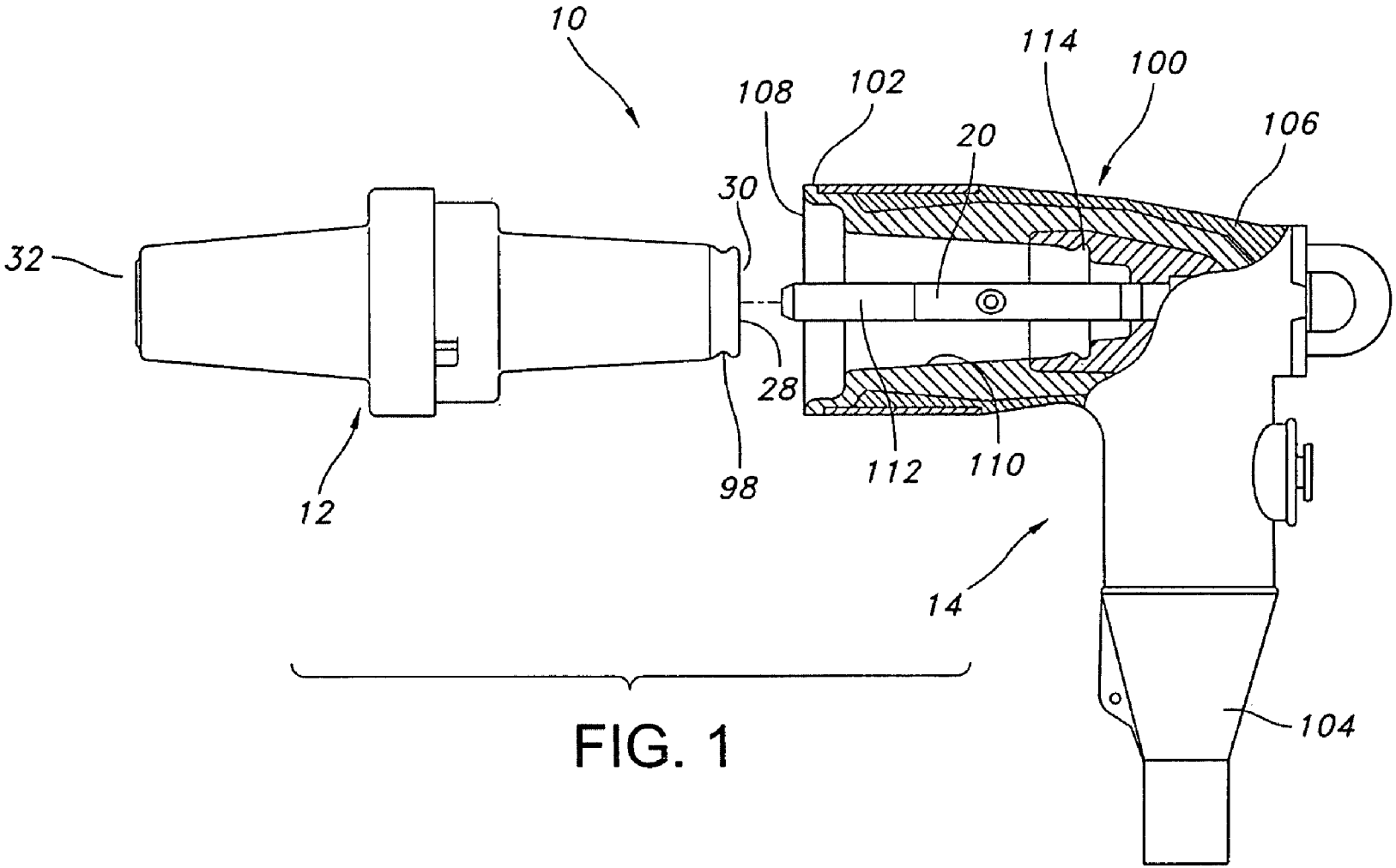
FIG. 1 is a side elevational view in partial cross section of a bushing insert electrical connector being mated with an elbow electrical connector for a power distribution system according to an exemplary embodiment of the invention.
Figure 2:
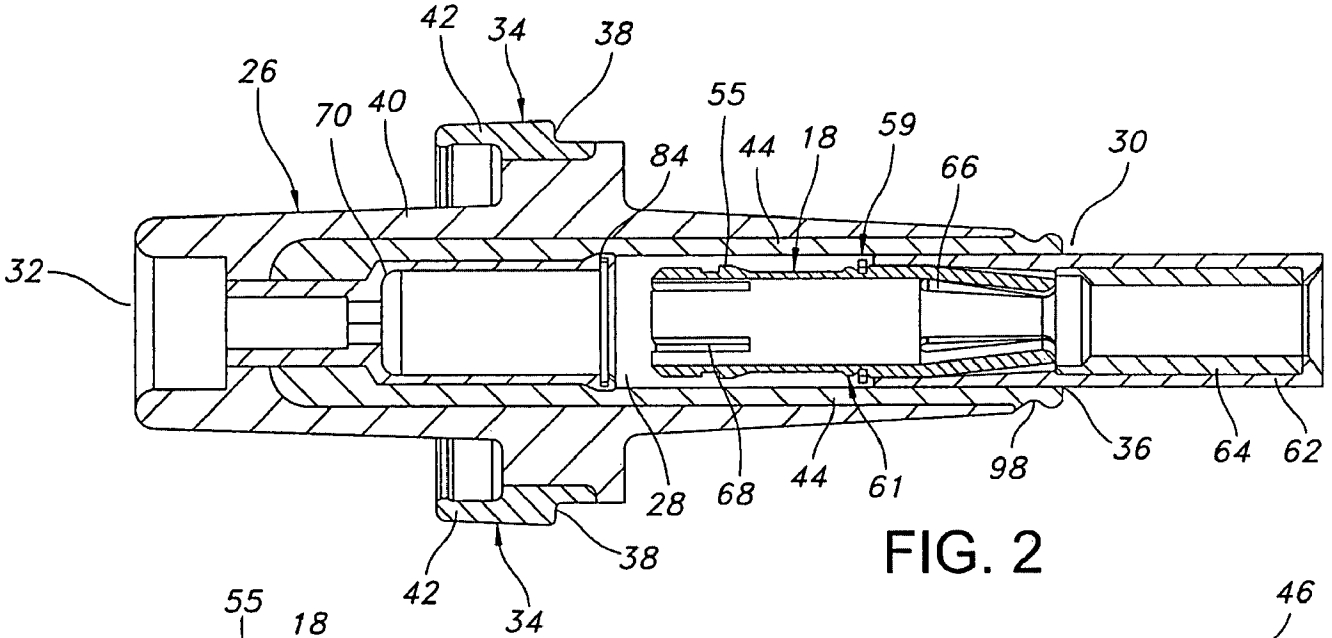
FIG. 2 is a side elevational view in cross section of the bushing insert electrical connector of FIG. 1, including a piston-contact element with a piston lockout member according to an exemplary embodiment of the invention.
Figure 3:
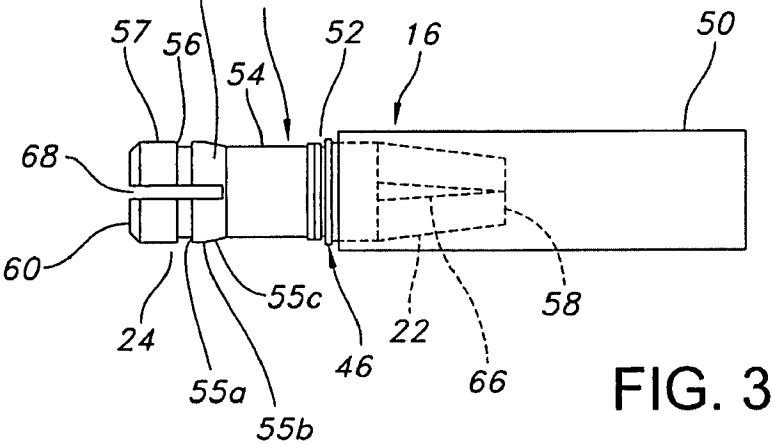
FIG. 3 is a side elevational view in cross section of the piston-contact element of FIG. 2 according to an exemplary embodiment of the invention.
Figure 5:
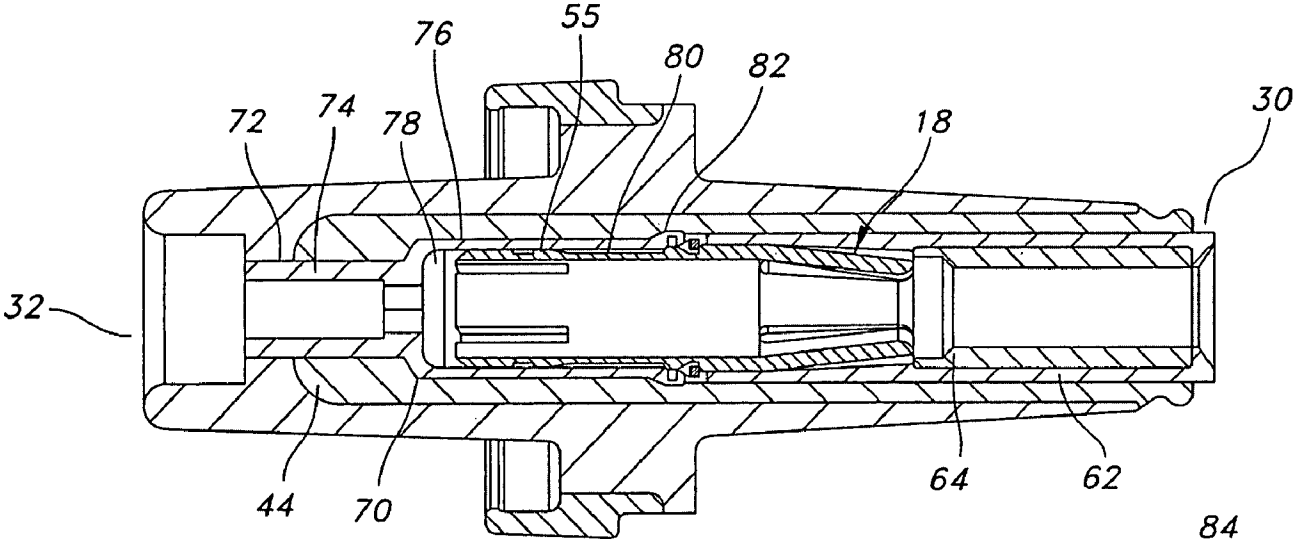
FIG. 5 is a side-elevational view in cross section of the bushing insert electrical connector of FIG. 2, showing the piston-contact element in a position prior to engagement with a piston subassembly angled wall according to an exemplary embodiment of the invention.
Figure 6:
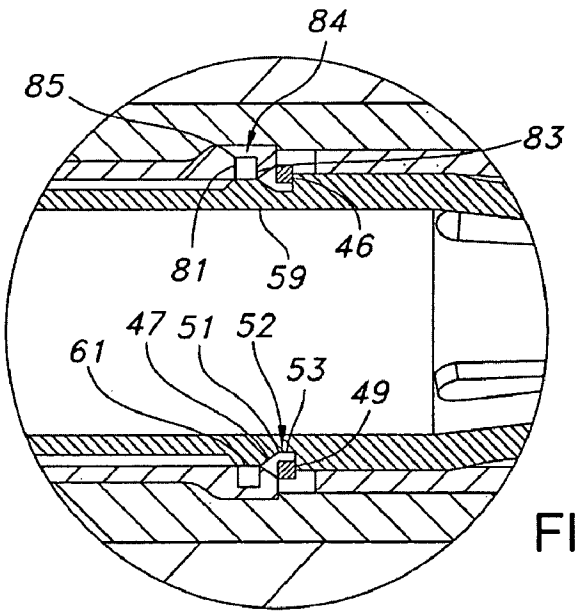
FIG. 6 is an enlarged side elevational view in cross section of the bushing insert electrical connector of FIG. 2, showing the piston-contact element in a position prior to engagement with the piston subassembly angled wall according to an exemplary embodiment of the invention.
Figure 7:
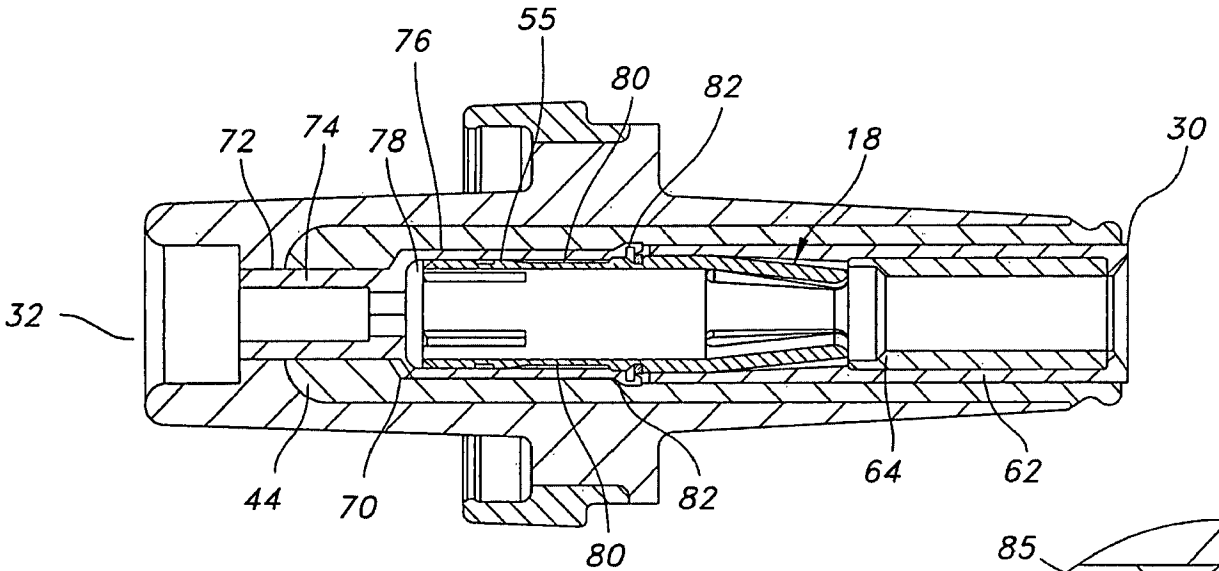
FIG. 7 is a side elevational view in cross section of the bushing insert electrical connector of FIG. 2, showing the piston-contact element in engagement position with the piston subassembly angled wall according to an exemplary embodiment of the invention.
Figure 8:
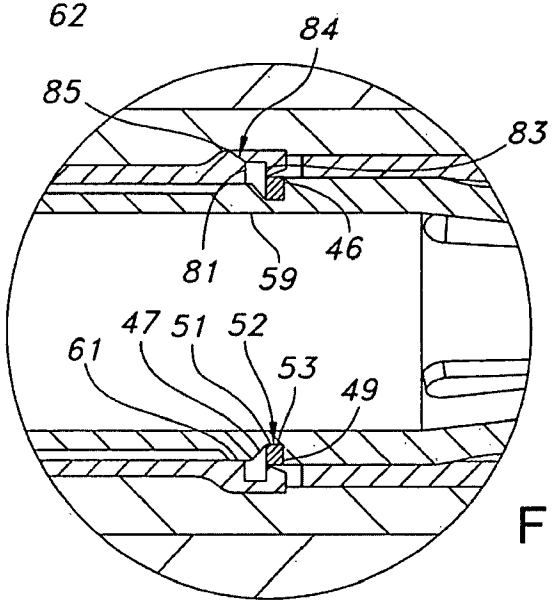
FIG. 8 is an enlarged side elevational view in cross section of the bushing insert electrical connector of FIG. 2, showing the piston-contact element in engagement with the piston subassembly angled wall according to an exemplary embodiment of the invention.

Referring to FIGS. 1-15, an electrical connector assembly 10 of a power distribution system includes an electrical connector 12, such as a high-voltage bushing insert, adapted to mate with an electrical device 14, such as an elbow cable-connector. As best seen in FIGS. 2-3, the electrical connector 12 includes a housing 26 with an inner bore 28 for receiving a snuffer tube assembly 16. The snuffer tube assembly has a piston-contact element 18 that engages a contact element 20 of the cable connector 14. The piston-contact element 18 is movable between first and second axially spaced positions within an inner bore 28 of the electrical connector 12. During fault closure, first and second contact portions 22, 24 of the piston-contact element 18 move toward the contact element 20 of the cable connector 14 to accelerate engagement thereof and to quench any arc that may have formed while the two contact elements 22, 24 and the contact element 20 approach engagement. A resilient member 46 restricts movement of the piston-contact element 18.

The housing 26 includes a first open end 30 and a second end 32 opposite the first open end 30. A middle portion 34 is positioned between first and second ends 30, 32. The first end 30 is connected to a cable connector 14 through an opening 36 providing access to the inner bore 28. The middle portion 34 is connected to ground. The second end 32 connects to a bushing well (not shown) as is well known and conventional in the art. First, and second ends 30, 32 are generally cylindrical with a slight taper from the middle portion 34 to the respective end of the housing 26. The shape of the first end 30, in particular, is adapted to fit within the cable connector 14, as is best seen in FIG. 1. The middle portion 34 is radially wider than the first and second ends 30, 32 and has a transition shoulder 38 between the middle portion 34 and first end 30.

The housing 26 of the electrical connector 12 is a molded unitary member formed of an insulative body 40 with an outer conductive layer 42 located at the middle portion 34 and with an inner conductive casing 44 defining the inner bore 28. The outer layer 42 can be made of a conductive rubber. The insulative body 40 can be made of an insulating rubber. The inner conductive casing 44 can be made of conductive rubber or nylon (for example, insulative glass filled nylon). Alternatively, a conductive paint or adhesive over the top of the nylon may be used. At least a portion the inner casing 44 includes a piston subassembly 70 having a bore retaining groove 84 therein.

The snuffer tube assembly 16 is received within housing inner bore 28. As best seen in FIG. 3, the snuffer tube assembly 16 generally includes the piston-contact element 18, a resilient member 46 having a slot 48 for permitting expansion and compression of the resilient member 46, and a snuffer tube 50. The piston-contact element 18 can be made of any conductive material, such as metal, and has a first end 58, a second end 60, and a middle portion 59. The piston-contact element 18 has an outer surface 54 having a substantially annularly-shaped and continuous element retaining groove 52; for receiving the resilient member 46.

As seen in FIGS. 2 and 3, the snuffer tube 50 is connected to the piston-contact element 18 proximate the first end 58 of the piston-contact element 18, as is well known in the art. As best seen in FIG. 2, the snuffer tube 50 includes an outer sleeve 62, which can be made of conductive rubber or nylon. The snuffer tube also includes an inner ablative, member 64 for providing extinguishing gases, as is known in the art.

The piston-contact element first end 58 receives contact 20 of the cable connector 14. The second end 60 also receives contact 20 of the cable connector 14 and acts as a piston. Both first and second ends 58, 60 may include resilient probe fingers 66 and resilient contact fingers 68. Resilient probe fingers 66 facilitate engagement of the contact element 20 of the cable connector 14 and ensure a good connection. Resilient contact fingers 68 facilitate connection with the piston subassembly 70 and also ensure a good connection. The resilient probe and contact fingers 66, 68 are shaped to allow insertion of the piston-contact element 18 into the inner bore 28 in one direction, while preventing its removal.

Figure 13:
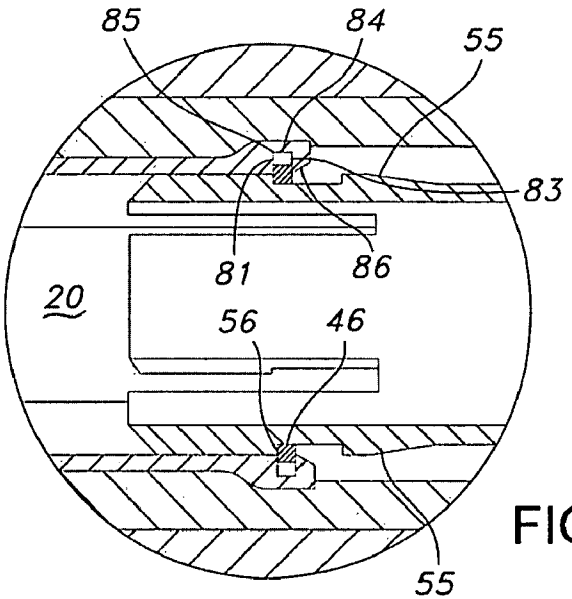
FIG. 13 is an enlarged side elevational view in cross section of the bushing insert electrical connector of FIG. 2, showing the piston-contact element in an advanced position according to an exemplary embodiment of the invention.
Figure 14A:
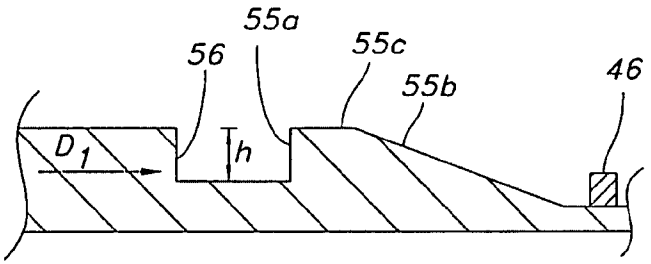
FIGS. 14A-14D are enlarged side elevational views in cross section of the bushing insert electrical connector of FIG. 2, showing the piston-contact element as it moves to the advanced position according to an exemplary embodiment of the invention.
Figure 14B:
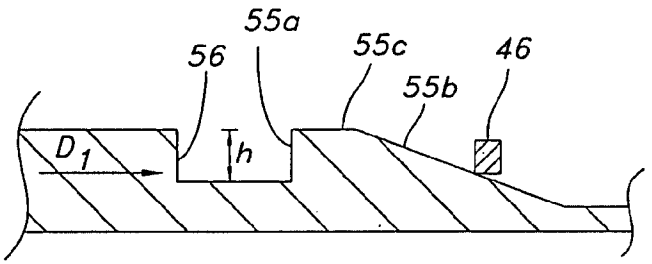

As best illustrated in FIGS. 3 and 13, the second end 60 of the piston-contact element 18 includes a stopping member 57 having an annular shoulder 56 for abutting the resilient member 46 and limiting travel of the piston-contact element 18 within inner bore 28 in a direction D1 illustrated in FIGS. 14A-14B. In an exemplary embodiment, the annular shoulder prevents the piston-contact element 18 from advancing more than substantially about one inch towards the first end 30 of the electrical connector 12.

Figure 14C:
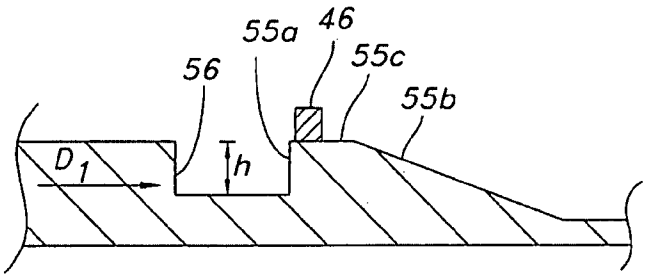
Figure 14D:
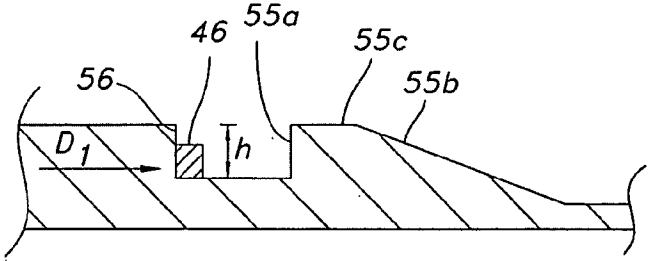
Figure 15:
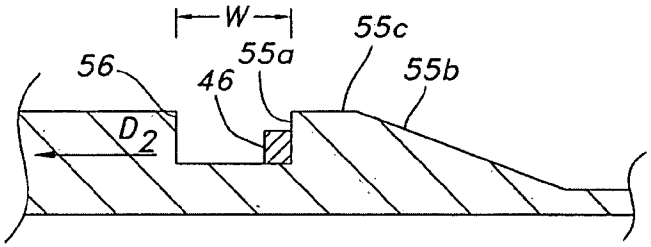
FIG. 15 is an enlarged side elevational view in cross section of the bushing insert electrical connector of FIG. 2, showing a piston lockout member engaging the resilient member in accordance with an exemplary embodiment of the invention.

The piston-contact element 18 also includes a lockout member 55. As best illustrated in FIGS. 13-15, the lockout member 55 includes an annular shoulder 55*a* for abutting the resilient member 46 and limiting travel of the piston-contact element 18 within the inner bore 28 in a direction D2 illustrated in FIG. 15. A height h of the annular shoulder 55*a* is substantially equal to a height of the annular shoulder 56 of the stopping member 57. The lockout member 55 also includes a substantially inclined wall 55*b* that facilitates positioning of the resilient member 46 between the annular shoulders 55*a*, 56 when the piston-contact element 18 advances during a fault closure, thereby locking the piston-contact element 18 in the advanced position, as best seen in FIG. 15. A width w between the annular shoulders 55*a*, 56 is sized to accommodate the resilient member 46.

Figure 4:
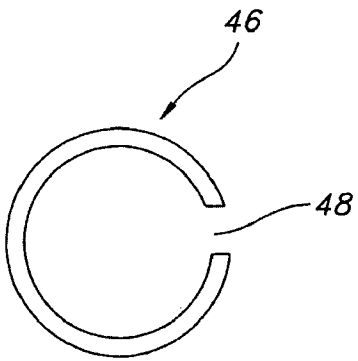
FIG. 4 is a side elevational view of a resilient member for releasably retaining the piston-contact element in the inner bore of the bushing insert electrical connector according to an exemplary embodiment of the invention.

As illustrated in FIG. 4, the resilient member 46 is substantially ring shaped and can be spring biased. The resilient member 46 allows the piston-contact element 18 to be slidably inserted into the inner tube 28 of the electrical connector 12 and releasably retains the piston-contact element 18 with respect to the inner tube 28 such that the piston-contact element 18 cannot be easily removed. Resilient member 46 also allows the piston-contact element 18 to slide with respect to the electrical connector 14 when mating with the cable connector 12 during fault conditions.

As illustrated in FIGS. 6, 8, 10, and 13, the piston-contact element retaining groove 52 includes a first side wall 49, a second side wall 51, and an end wall 53 for receiving the resilient member 46. An angled wall 47 extends from the second side wall for facilitating disengagement and spacing of the resilient member 46 from the element retaining groove 52 during fault conditions as seen in FIG. 13.

FIGS. 6, 8, 10, and 12 also illustrate the middle portion 59 of the piston-contact element 18. The middle portion 59 includes a substantially annularly shaped tapered protrusion 61. The tapered protrusion 61 is located proximate the angled wall 47 and has a tapered back side. The tapered protrusion 61 facilitates disengagement of the resilient member 46 from the element retaining groove 52, as best seen in FIG. 11, permitting the piston-contact element 18 to be advanced to a second position during fault conditions as seen in FIG. 13.

The second end 32 of the housing 26 includes a bushing well (not shown). A metal (for example, copper) piston subassembly 70 is releasably connected to the bushing well by any suitable fastening means, preferably by a threadable connection. The piston subassembly is constructed of a metal, such as copper. As shown in FIGS. 5, 7, 9, and 12, the piston subassembly 70 has a first section 72 and a second section 76. The first section 72 includes a nose cone 74 for mating with the bushing well. The second section 76 has inner and outer surfaces 80, 82. The inner surface 80 defines the perimeter of a substantially U-shaped chamber receiving the piston-contact element 18 of the snuffer tube assembly 16. The piston subassembly 70 and the inner conductive casing 44 are integrally connected, defining an inner surface of the inner bore 28. The piston subassembly 70 may be independently positioned as a separate element adjacent to the inner conductive casing 44 or alternatively the inner conductive casing 44 and the piston subassembly 70 can be one element.

Figure 9:
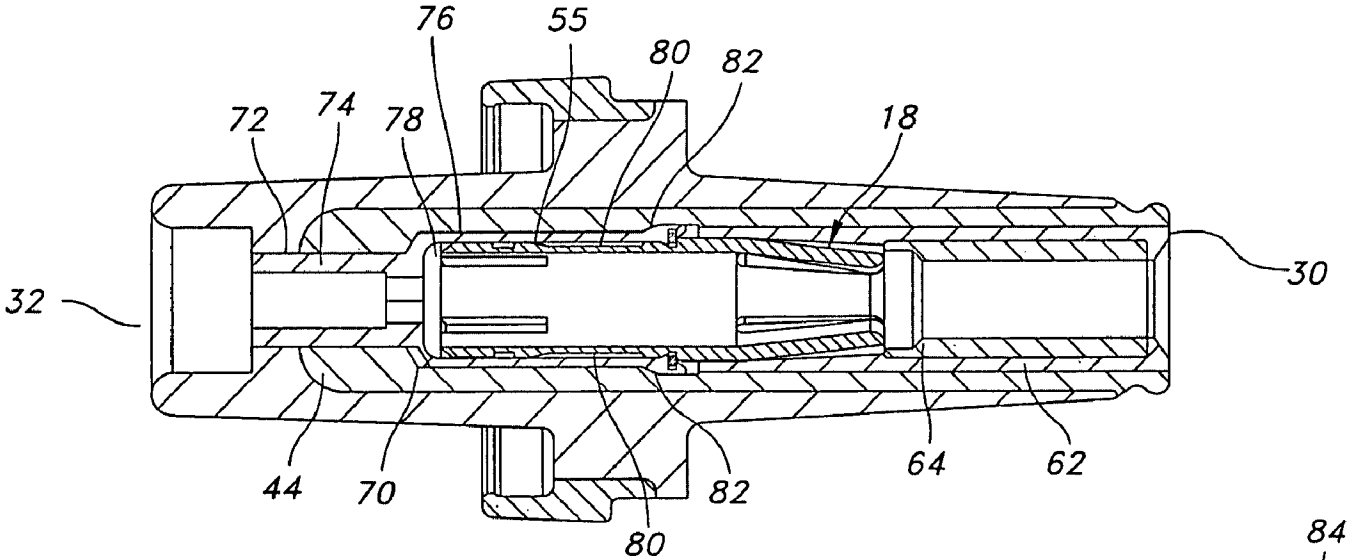
FIG. 9 is a side elevational view in cross section of the bushing insert electrical connector of FIG. 2, showing the piston-contact element in the retracted home position according to an exemplary embodiment of the invention.

As best seen in FIG. 9, when the piston-contact element 18 is in the fully retracted home position, a space 78 remains between the U-shaped chamber defined by the inner surface 80 of the piston subassembly 70 and the second end 60 of the piston-contact element 18. During fault closure or short circuit conditions, gases are generated which fill the chamber space 78. As the gases occupy the space 78, the pressure within the space 78 increases, generating a force against the second end 60 of the piston-contact element 18. This force is sufficient enough to overcome the force applied to the piston-contact element 18 by the resilient member 46.

As best seen in FIGS. 6, 8, 10, and 13, the inner surface 80 of the piston subassembly 70 includes a substantially annularly-shaped bore retaining groove 84 having a first side wall 81, a second side wall 83, and an end wall 85. A substantially angled wall 86 extends from the second side wall 83. The substantially annularly shaped bore retaining groove 84 receives the resilient member 46 located on the piston-contact element 18. The substantially angled wall 86 extends from the inner surface 80 toward the outer surface 82 of the piston subassembly 70. The angled wall 86 facilitates positioning of the piston-contact element 18 in the U-shaped chamber of the piston subassembly 70.

The angled wall 86 guides the piston-contact element 18 into alignment with the annular bore retaining groove 84. Specifically, as the piston-contact element 18 of the snuffer tube assembly is further inserted into the inner bore 28 of the electrical connector 12, the angled wall 86 compresses the resilient member 46. Subsequently, as the piston-contact element 18 is advanced to a position beyond the tapered edge section 86, the compressive force placed upon the resilient member 46 by the angled wall 86 is removed, and the resilient member 46 expands. The resilient member 46 expands and snaps into the corresponding bore retaining groove 84 located on the inner surface 80 of the piston subassembly 70, thereby locking the piston-contact element 18 in the home position, as is best seen in FIG. 9.

Operation

The electrical connector 12 connects to the cable connector 14. Since the cable connector 14 is well known in the art, it will be described only generally. Cable connector 14 includes an insulative housing 100 with first and second ends 102, 104 and an outer conductive jacket 106, as best seen in FIG. 1. The first end 102 includes an opening 108 for receiving the electrical connector 12 into a bushing port 110 of the cable connector 14. Extending through the bushing port 110 is the contact element or conductive probe 20. As best seen in FIGS. 1-2, the contact element 20 is received within the inner bore 28 of the electrical connector 12, through the resilient probe fingers 66, upon connection of the electrical connector 12 and the cable connector 14. The contact element 20 includes an insulating ablative member 112 to provide arc quenching gases, as is known in the art. The bushing-port 110 is shaped to receive the first end 30 of the electrical connector 12. The cable connector 14 includes a groove 114 that mates with an extended lip 98 of the first end 30 of the electrical connector 12. The second end 104 of the cable connector 14 receives a cable (not shown) that is electrically connected to the contact element 20. Although the cable connector 14 is shown as an elbow or L-shaped connector, the electrical connector 12 can be connected to any type of cable connector known in the art.

Referring to FIGS. 5-13, during fault closure, by moving from a retracted (home) position to an extended (advanced) position, the snuffer tube assembly 16 accelerates the connection of the piston-contact element 18 of the electrical connector 12 and the contact element 20 of the cable connector 14, thereby quenching the formation of an arc and preventing injury to the operator. During fault closure, as the electrical connector 12 and the cable connector 14 approach one another, with electrical connector 12 being inserted into the bushing port 110 of the cable connector 14, an arc is formed between the piston-contact element 18 and the contact element 20, thus triggering the generation of arc quenching gases from the ablative members 64, 112, as is known in the art.

Figure 10:
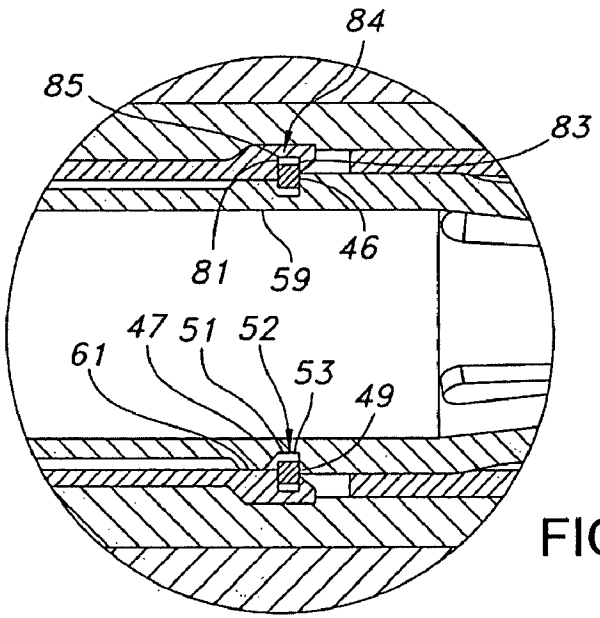
FIG. 10 is an enlarged side elevational view in cross section of the bushing insert electrical connector of FIG. 2, showing the piston-contact element in the retracted home position according to an exemplary embodiment of the invention.
Figure 11:
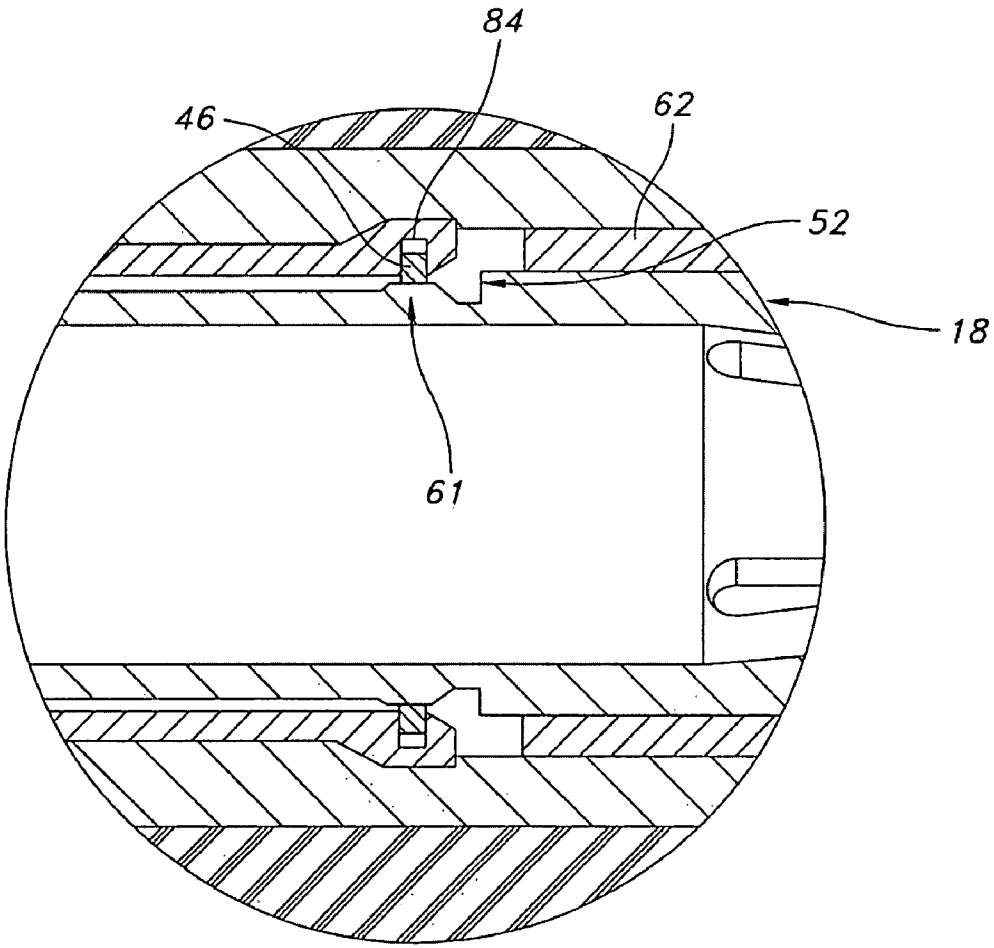
FIG. 11 is an enlarged side elevational view of the piston-contact element tapered protrusion expanding the resilient member and spacing the resilient member from the element retaining groove according to an exemplary embodiment of the invention.
Figure 12:
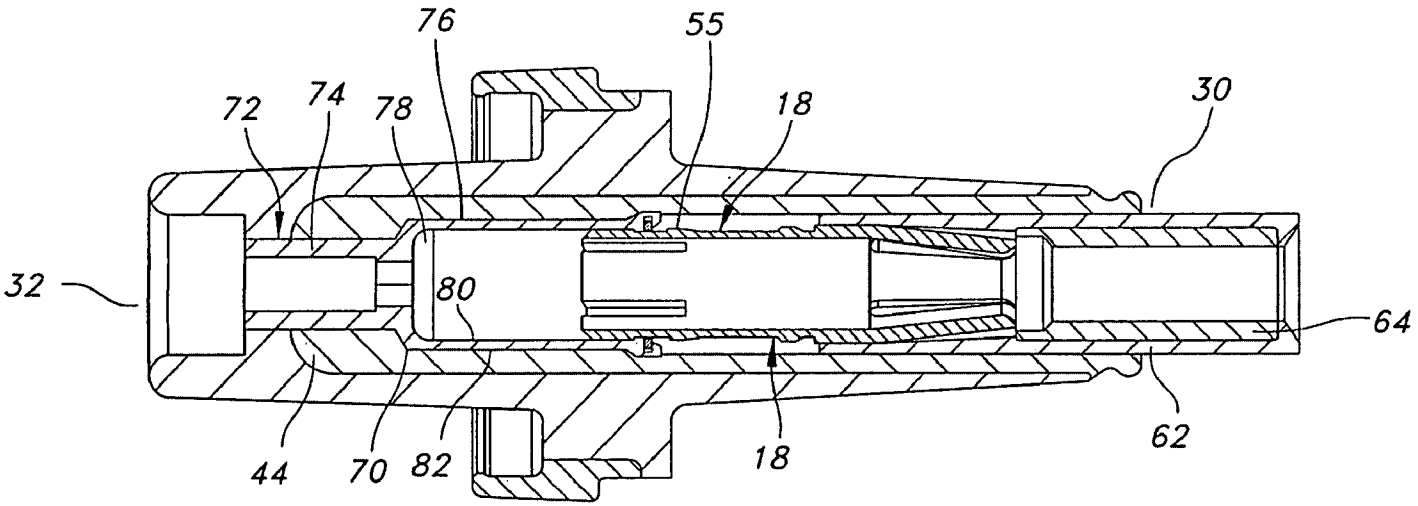
FIG. 12 is a side elevational view in cross section of the bushing insert electrical connector of FIG. 2, showing the piston-contact element in an advanced position according to an exemplary embodiment of the invention.

During normal operation, piston-contact assembly 18 is in the retracted home position, as best seen in FIGS. 9-10. During a fault closure, gases are generated. As seen in FIGS. 12-13, as the electrical connector 12 is advanced further into the bushing port 110 of the cable connector 14, the generated gases from the ablative members 64, 112 fill up space 78 located in a U-shaped chamber of the piston subassembly 70 by passing around the piston-contact assembly or through the interior cavity of the piston-contact element 18. As the gases occupy space 78, the pressure increases, and thus a force acts upon the second end 60 of the piston-contact element 18 and initiates movement by overcoming the force applied by resilient member 46.

Consequently, the piston-contact element 18 is forced in a direction D1 (FIGS. 14A-14D) towards the first end 30 of the electrical connector 12. As the piston-contact element 18 is advanced, the angled wall 47 of the element retaining groove 52 initiates an expansion force against the resilient member 46. The force increases as the piston-contact element 18 is advanced. The force acting upon the resilient member 46 increases until the tapered protrusion 61 is reached, and the expansion force plateaus, as best seen in FIG. 11. During this time, the piston-contact element 18 is released from the resilient member 46 and permitted to advance towards the first end 30 of the electrical connector 12 under pressure from the generated gases, thus accelerating the connection of the piston-contact element 18 and the contact element 20. When the piston-contact element 18 is released from the resilient member 46 and permitted to advance towards the first end 30 of the electrical connector 12, the resilient member 46 is located in position A as illustrated in FIG. 14A.

As the piston-contact element 18 continues to advance in the direction D1, the angled wall 55*b* of the lockout member 55 initiates an expansion force against the resilient member 46. At this point, the resilient member 46 is located substantially in position B as illustrated in FIG. 14B. The force increases as the piston-contact element 18 is advanced. The force acting upon the resilient member 46 increases until the resilient member 46 is disposed adjacent to a plateau 55*c* of the lockout member 55, and the expansion force plateaus. At this point, the resilient member 46 is located substantially in position C as illustrated in FIG. 14C.

The piston-contact element 18 can only be advanced a limited distance. As the piston-contact element 18 continues to advance in the direction D1, the annular shoulder 56 of the stopping member 57 prevents any further advancement in the direction D1 when engaged by the resilient member 46. At this point, the resilient member 46 is located substantially in position D as illustrated in FIG. 14D, which is the extended (advanced) position.

In an exemplary embodiment, the snuffer tube assembly 16, including the piston-contact element 18, is permitted to travel within the inner bore 28 of the electrical connector 12 substantially about one inch.

After advancement of the piston-contact element 18, the piston-contact element 18 cannot be reset to the retracted home position. If an operator attempts to move the piston-contact element 18 in the direction D2 illustrated in FIG. 15, then the annular shoulder 55*a* of the lockout member 55 prevents any further advancement in the direction D2 when engaged by resilient member 46. Because the lockout member 55 prevents resetting the piston-contact element 18 to the retracted home position, an operator will not have a false indication that the electrical connector 12 is safe for future connections to the cable connector 14. The protrusion of the snuffer tube assembly 16 from the end 30 of the electrical connector 12 provides a visual indication to an operator that the cable connector 14 should not be connected to the electrical connector 12.

Under normal operating conditions, that is other than fault conditions, the intensity of the arc during connection of the electrical connector 12 and the cable connector 14 is moderate and thus does not create enough pressure in the piston subassembly 70 chamber space 78 to move the piston-contact element 18. Thus, it is generally only under fault conditions that the piston-contact element 18 moves between the retracted and advanced positions.

In conclusion, the foregoing exemplary embodiments enable an electrical connector with a fault closure lockout feature. Many other modifications, features, and embodiments will become evident to a person of ordinary skill in the art having the benefit of the present disclosure. It should be appreciated, therefore, that many aspects of the invention were described above by way of example only and are not intended as required or essential elements of the invention unless explicitly stated otherwise. It should also be understood that the invention is not restricted to the illustrated embodiments and that various modifications can be made within the spirit and scope of the following claims.

I claim:

1. An electrical connector, comprising:

a housing comprising an inner bore and an open end providing access to the inner bore, the inner bore having an inner surface and a bore retaining groove disposed in the inner surface;

a snuffer tube comprising opposing first and second ends and an ablative material extending substantially between the first and second ends;

a piston-contact element comprising a conductive member adapted to engage an electrical contact of another electrical connector to complete a circuit that includes each electrical connector, the piston-contact element coupled to the first end of the snuffer tube and slidable in conjunction with the snuffer tube, the piston-contact element being substantially within the inner bore of the housing, through the open end, the piston-contact element being axially movable within the connector from a retracted position to an advanced position in response to arc extinguishing gas provided by the ablative material of the snuffer tube upon a fault condition, the second end of the snuffer tube being disposed (a) substantially within the inner bore of the housing in the retracted position and (b) substantially outside of the inner bore of the housing in the advanced position, and the piston-contact element comprising an outer surface having an element retaining groove and a lockout member; and a resilient member received in each of the retaining grooves to releasably retain the piston-contact element in the retracted position, wherein, after the piston-contact element moves from the retracted position to the advanced position, the lockout member engages the resilient member to retain the piston-contact element in the advanced position and prevents the piston-contact element from being moved from the advanced position to the retracted position.

2. The electrical connector according to claim 1, wherein the retaining grooves are each substantially annular and continuous.

3. The electrical connector according to claim 1, wherein the bore retaining groove comprises first and second side walls and an end wall extending therebetween, and wherein an angled wall extends from the second side wall to facilitate engagement of the resilient member in the bore retaining groove.

4. The electrical connector according to claim 1, wherein the element retaining groove comprises first and second side walls and an end wall extending therebetween, the second side wall being angled with respect to the first side wall to facilitate disengagement of the resilient member from the element retaining groove.

5. The electrical connector according to claim 1, wherein an electrical contact of another electrical connector is received in the inner bore of the housing through the open end and engages the piston-contact element.

6. The electrical connector according to claim 1, wherein the housing comprises an inner conductive sleeve, and wherein the bore retaining groove is disposed in the conductive sleeve.

7. The electrical connector according to claim 1, wherein the electrical connector is a high-voltage bushing insert.

8. The electrical connector according to claim 1, wherein the lockout member comprises a shoulder configured to abut the resilient member when the piston-contact element is moved in a direction from the advanced position toward the retracted position, thereby retaining the piston contact element in the advanced position.

9. The electrical connector according to claim 8, wherein the shoulder of the lockout member is substantially annular and continuous.

10. The electrical connector according to claim 8, wherein the piston-contact element further comprises a stop substantially preventing removal of the piston-contact member from the inner bore of the housing, and wherein the lockout member further comprises a wall angled away from the outer surface in a direction from the retracted position toward the advanced position, the wall of the lockout member facilitating positioning of the resilient member between the stop and the annular shoulder of the lockout member when the piston-contact element moves from the retracted position to the advanced position.

11. The electrical connector according to claim 8, wherein the annular shoulder of the lockout member is disposed substantially perpendicular to the outer surface.

12. The electrical connector according to claim 1, wherein the piston-contact element comprises opposing first and second ends, the first end being adapted to engage another electrical connector, and the second end comprising a stop substantially preventing removal of the piston-contact member from the inner bore of the housing.

13. The electrical connector according to claim 12, wherein the stop comprises an annular shoulder abutting the resilient member in the advanced position.

14. The electrical connector according to claim 12, wherein the first end of the piston-contact element comprises probe fingers, and wherein the second end of the piston-contact element comprises a piston.

15. The electrical connector according to claim 14, wherein the probe fingers and the piston-contact element together form a unitary, one-piece member.

16. The electrical connector according to claim 1, wherein the resilient member comprises a substantially ring shaped spring.

17. The electrical connector according to claim 16, wherein the resilient member comprises a slot that allows expansion and compression of the resilient member.

18. The electrical connector according to claim 1, wherein the piston-contact element is in the retracted position when the resilient member is received in both of the retaining grooves, and wherein the piston-contact element is in the advanced position when the resilient member is received in the bore retaining groove and is spaced from the element retaining groove.

19. The electrical connector according to claim 18, wherein the resilient member is received in both the element and bore retaining grooves when the piston-contact element is in the retracted position.

20. A high-voltage bushing insert for mating with a cable connector, comprising:

a housing comprising an inner bore and an open end providing access to the inner bore, the inner bore having an inner surface and a bore retaining groove disposed in the inner surface;

a piston-contact element slidably received in the inner bore of the housing through the open end, the piston-contact element being axially movable within the connector between retracted and advanced positions and comprising an outer surface having an element retaining groove and a lockout member; and a resilient member received in each of the retaining grooves to releasably retain the piston-contact element in the retracted position, wherein the piston-contact element is in the retracted position during normal operation and is moved from the retracted position to the advanced position automatically by gases generated during fault conditions, the lockout member engaging the resilient member in the advanced position, thereby retaining the piston-contact element in the advanced position and preventing the piston-contact element from being moved from the advanced position to the retracted position.

21. The bushing insert according to claim 20, wherein the lockout member comprises a shoulder configured to abut the resilient member when the piston-contact element is moved in a direction from the advanced position toward the retracted position, thereby retaining the piston contact element in the advanced position.

22. The bushing insert according to claim 21, wherein the shoulder of the lockout member is substantially annular and continuous.

23. The bushing insert according to claim 21, wherein the piston-contact element further comprises a stop substantially preventing removal of the piston-contact member from the inner bore of the housing, and wherein the lockout member further comprises a wall angled away from the outer surface in a direction from the retracted position toward the advanced position, the wall of the lockout member facilitating positioning of the resilient member between the stop and the annular shoulder of the lockout member when the piston-contact element moves from the retracted position to the advanced position.

24. The bushing insert according to claim 20, wherein the piston-contact element is in the retracted position when the resilient member is received in both of the retaining grooves, and wherein the piston-contact element is in the advanced position when the resilient member is received in the bore retaining groove and is spaced from the element retaining groove.

25. The bushing insert according to claim 24, wherein the resilient member is received in both the element and bore retaining grooves when the piston-contact element is in the retracted position.

26. The bushing insert according to claim 24, wherein the piston-contact element further comprises an annular shoulder extending outwardly from the outer surface of the piston-contact element, the annular shoulder engaging the resilient member in the advanced position to substantially prevent removal of the piston-contact element from the inner bore of the housing.

27. A high-voltage bushing insert for mating with a cable connector, comprising:

a housing comprising an inner bore and an open end providing access to the inner bore, the inner bore having an inner surface and a bore retaining groove disposed in the inner surface;

a piston-contact element slidably received in the inner bore of the housing through the open end, the piston-contact element being axially movable within the connector between retracted and advanced positions and comprising an outer surface having an element retaining groove and a lockout member; and a resilient member received in each of the retaining grooves to releasably retain the piston-contact element in the retracted position, wherein the piston-contact element is in the retracted position during normal operation and is moved from the retracted position to the advanced position during fault conditions, the lockout member engaging the resilient member in the advanced position, thereby fixedly retaining the piston-contact element in the advanced position such that the piston-contact element cannot be moved from the advanced position to the retracted position.

28. The bushing insert according to claim 27, wherein the lockout member comprises a shoulder configured to abut the resilient member when the piston-contact element is moved in a direction from the advanced position toward the retracted position, thereby retaining the piston contact element in the advanced position.

29. The bushing insert according to claim 28, wherein the shoulder of the lockout member is substantially annular and continuous.

30. The bushing insert according to claim 28, wherein the piston-contact element further comprises a stop substantially preventing removal of the piston-contact member from the inner bore of the housing, and wherein the lockout member further comprises a wall angled away from the outer surface in a direction from the retracted position toward the advanced position, the wall of the lockout member facilitating positioning of the resilient member between the stop and the annular shoulder of the lockout member when the piston-contact element moves from the retracted position to the advanced position.

31. The bushing insert according to claim 27, wherein the piston-contact element is in the retracted position when the resilient member is received in both of the retaining grooves, and wherein the piston-contact element is in the advanced position when the resilient member is received in the bore retaining groove and is spaced from the element retaining groove.

32. The bushing insert according to claim 31, wherein the resilient member is received in both the element and bore retaining grooves when the piston-contact element is in the retracted position.

33. The bushing insert according to claim 31, wherein the piston-contact element further comprises an annular shoulder extending outwardly from the outer surface of the piston-contact element, the annular shoulder engaging the resilient member in the advanced position to substantially prevent removal of the piston-contact element from the inner bore of the housing.

* * * * *